US005601499A

United States Patent [19]

Segaline

[11] Patent Number: 5,601,499

[45] Date of Patent: Feb. 11, 1997

[54] GOLF PUTTER

[76] Inventor: Frank W. Segaline, 717 Mamie Rd., El Paso, Tex. 79932

[21] Appl. No.: 524,654

[22] Filed: Sep. 8, 1995

[51] Int. Cl.[6] ..... A63B 53/04

[52] U.S. Cl. ..... 473/313; 473/328; 473/340

[58] Field of Search ..... 273/167 R, 167 A, 273/167 B, 167 D, 167 F, 167 H, 167 J, 168, 169, 171, 172, 173, 174, 193 R, 194 R, 186.1, 186.2, 187.4, 164.1, 162 R, 80.1, 80.2, 87 C, 77 R; D21/217; 473/324–350

[56] References Cited

U.S. PATENT DOCUMENTS

| | | | |
|---|---|---|---|
| 1,525,137 | 2/1925 | Lawton | 273/80.2 |
| 2,478,468 | 8/1949 | Drake | 273/167 A |
| 4,265,451 | 5/1981 | Bernhardt | 273/167 F |
| 4,747,599 | 5/1988 | Antonious | 273/80.2 |
| 4,921,253 | 5/1990 | Tesori | 273/167 B |
| 5,176,379 | 1/1993 | Reinberg . | |
| 5,290,035 | 3/1994 | Hannon et al. . | |
| 5,308,068 | 5/1994 | Strand . | |
| 5,314,184 | 5/1994 | Schmidt | 273/80.2 |
| 5,368,302 | 11/1994 | Thomas . | |

*Primary Examiner*—Sebastiano Passaniti
*Attorney, Agent, or Firm*—Schmeiser, Olsen & Watts

[57] ABSTRACT

A putter having a uniquely-shaped head designed to enhance the use of the club. The head has two 'J'-shaped end sections that function to balance the head while visually framing a center section of the head. The front face of the head is located at an elevated position atop a multicurved bottom surface. The shaft of the club is received in the head's central section at a point between the head's front and rear surfaces.

17 Claims, 3 Drawing Sheets

GOLF PUTTER

FIELD OF THE INVENTION

The invention is in the field of sports equipment. More particularly, the invention is a golf putter that has a unique design. The head portion of the putter includes two 'J'-shaped end portions that improve the head's functionality and balance. The head also has a solid, substantially rectilinear central area that is readily discernable to thereby enhance a user's ability to aim the head's movements. The central area also creates a large "sweet spot" in the portion of the head that is designed to contact a golf ball. The putter's shaft is secured to the head at a point that is relatively close to the head's front surface. This location functions to improve the user's feel and control of the putter. The design of the head also allows one to easily apply top spin to a ball.

BACKGROUND OF THE INVENTION

The game of golf provides a number of different situations that challenge different aspects of a golfer's skill. When the ball is located a great distance from the hole or cup, the golfer's strength and general accuracy are tested as he or she drives the ball toward the cup. Once the ball is located relatively near the cup, the golfer must hit the ball in a manner that tests his or her fine control and accuracy. In the latter situation, it is a common practice for a golfer to employ a specialized club called a putter for hitting the ball.

A putter typically features a relatively narrow metal head that is secured to one end of an elongated shaft having a handle portion. The attachment site between the shaft and the head is located either at the center of the head or proximate one of the head's ends. From the attachment area, the shaft extends outwardly from the head at a perpendicular or other angle relative to the longitudinal axis of the head.

A player expects his or her putter to be comfortable to hold, easy to aim and capable of contacting the ball in a controlled manner. A large number of different designs of putters have been invented in the past to achieve these goals. However, none of the designs have been completely successful.

While many prior art putters are considered satisfactory, there is still a need for a putter that will meet the above-described goals in an improved fashion. The objective of the invention is to provide a putter that, when compared to the prior art, is more comfortable to use, is easier to aim and control and is capable of impacting a golf ball in a more predictable manner.

SUMMARY OF THE INVENTION

The invention is an improved golf putter designed to facilitate putting. The putter has a specially-shaped head that makes the club easy to control and aim. The head has a large "sweet spot" and is relatively light-weight and well-balanced. This makes the putter comfortable to use and highly accurate.

The head portion of the putter is preferably made of a metal material and is in the form of a well-defined, solid central section sandwiched between two 'J'-shaped end sections. The central section creates a large "sweet spot" in the head for contacting the ball in a controlled and assured manner. The end sections visually frame the central section to thereby facilitate the aiming process. The shape of the end sections also improve the putter's balance while minimizing its weight.

The bottom of the head is curved both front to rear and from side-to-side. This minimizes the chances of the head catching on the green during a swing, both when the head is maintained in a single orientation or when the head is slightly rotated during the swing. The curvature also effectively raises the front face of the head to thereby allow a golfer to hit higher on the ball and thereby readily apply top spin to the ball. Additionally, the curved bottom surface of the putter's head facilitates a golfer's ability to angle the head for the application of spin to the ball. Furthermore, the curved bottom surface allows the head to be rocked during an impact with the ball. The latter described features provide the golfer with greater control of the impact and as a result, more reliability in affecting the ball's trajectory after the impact.

The shaft of the putter is made of a metal, wood or graphite material and is attached to the central section of the head. The attachment point is located nearer to the head's front surface than to its rear surface. This provides a golfer with a better feel of the hit/impact with a ball since the end of the shaft is located in extremely close proximity to the impact area. Alternatively, the attachment point can be located proximate the longitudinal axis of the head. The latter placement enhances the overall balance of the head.

DETAILED DESCRIPTION OF THE DRAWINGS

Figure 1:
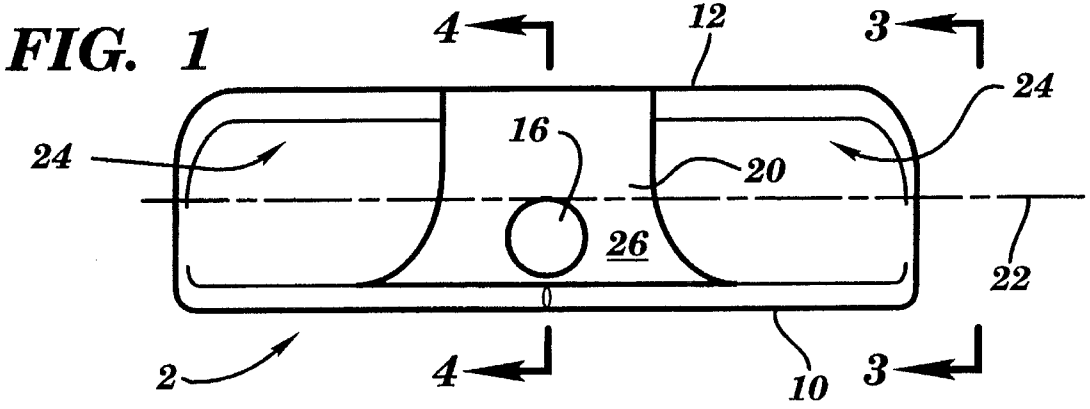
FIG. 1 is a plan view of a head portion of a golf putter in accordance with the invention.
Figure 4:
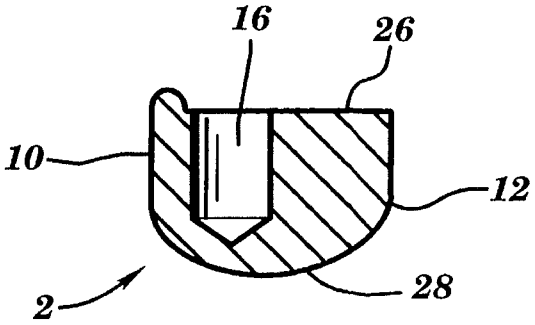
FIG. 4 is a cross-sectional view of the head portion shown in FIG. 1. The view is taken at the plane labeled 4—4 in FIG. 1.
Figure 3:
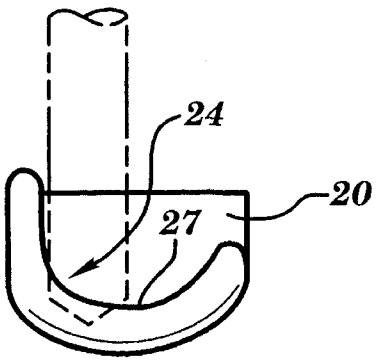
FIG. 3 is an end view of the head portion shown in FIG. 1. The shaft of the putter is shown in phantom.
Figure 2:
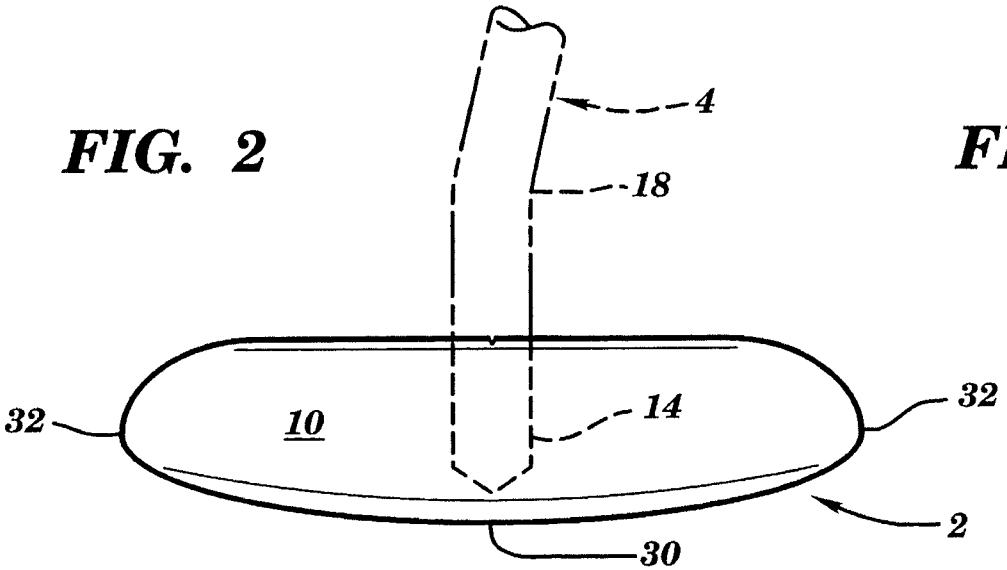
FIG. 2 is a side view of the head portion shown in FIG. 1. The shaft of the putter is shown in phantom.
Figure 5:
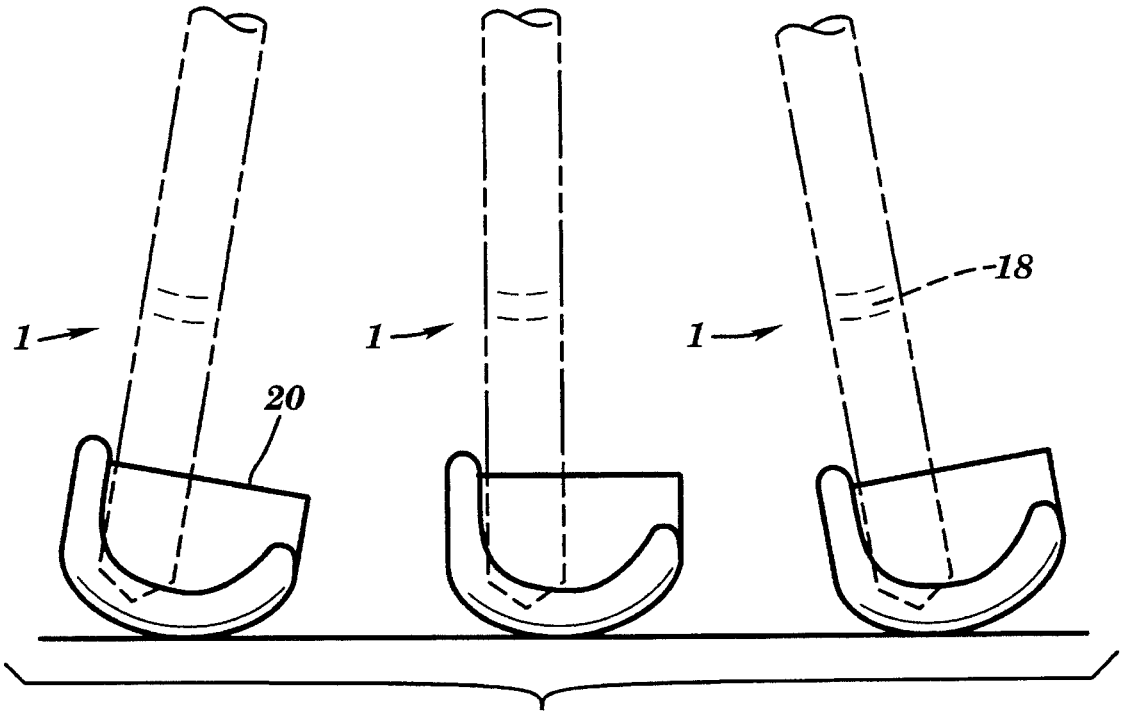
FIG. 5 is an end view of the head portion shown in FIG. 1. The shaft of the putter is shown in phantom. Also shown in phantom are two views of the putter with the head canted in two different orientations.

Referring now to the drawings in greater detail, wherein like reference characters refer to like parts throughout the several figures, there is shown by the numeral 1 a golf putter in accordance with the invention.

Figure 6:
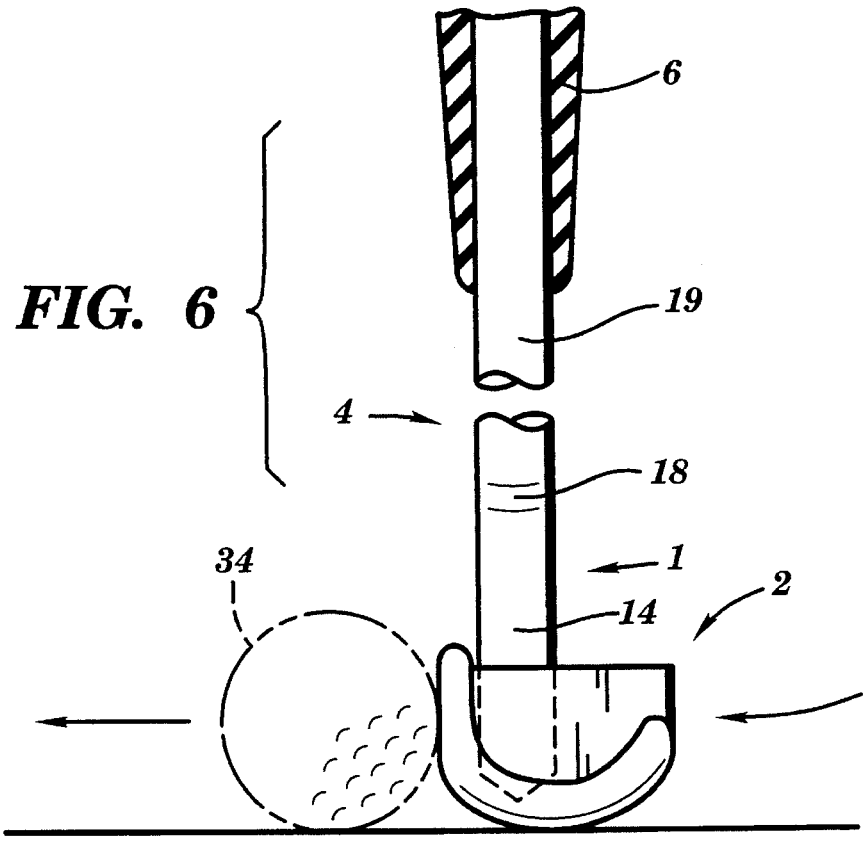
FIG. 6 is an end view of a putter in accordance with the invention. The putter is shown contacting a golf ball.

The putter has a head portion 2 and a shaft portion 4. A grip or handle 6 (note FIG. 6) is located at the distal end of the shaft portion.

The head portion 2 of the putter has a front surface 10 and a rear surface 12. The bottom end 14 of the shaft is received within a complementary bore 16 in the head. Securement is accomplished in the conventional manner using either a threaded engagement (not shown) or other type of well-known fastening methods. As can be seen in the figures, there is a bend 18 in the shaft just above its bottom portion 14. The bend makes an approximately 13 degree angle from the vertical. The distal portion 19 of the shaft then extends away at said angle from the head portion 2.

Figure 7:
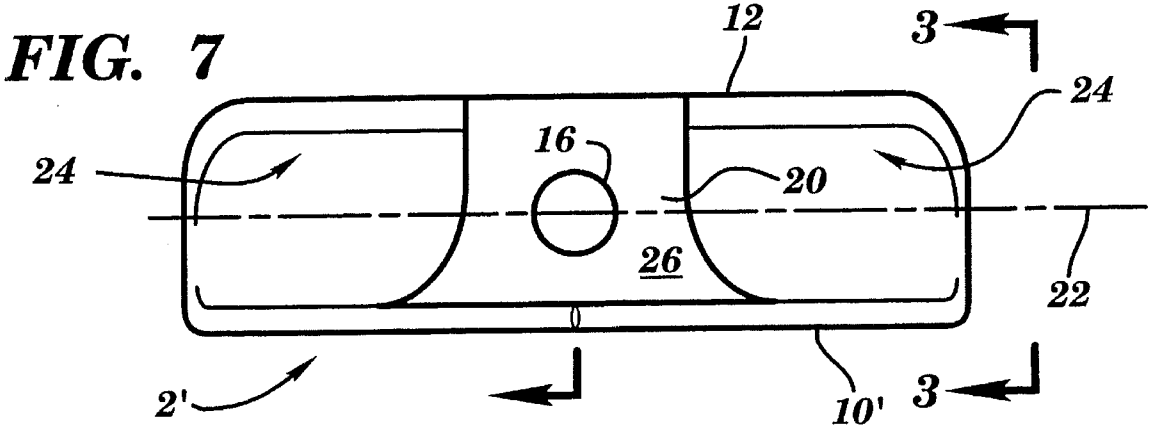
FIG. 7 is a plan view of a second embodiment of a head portion of a golf putter in accordance with the invention.
Figure 8:
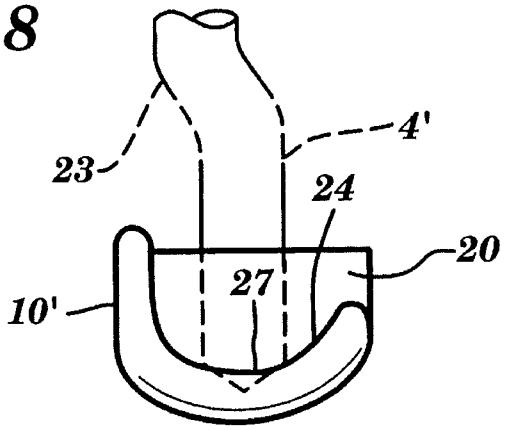
FIG. 8 is an end view of the head portion shown in FIG. 7. The shaft of the putter is shown in phantom.

The bore 16 is located within a substantially solid central section 20 of the head and is oriented perpendicular to the head's longitudinal axis 22. It should be noted that in FIGS. 1–6, the bore is located much closer to the front surface 10 of the head than to the rear surface 12. A second embodiment of the head 2' is shown in FIGS. 7 and 8. In these figures, the head is identical to that of the earlier figures except that the bore 16 is located at the midpoint of the head and is centered on the head's longitudinal axis 22. As shown in FIG. 8, the shaft 4' used with this embodiment will preferably also include a second bend 23 that, in combination with bend 18, causes the shaft to angle in a manner wherein it extends almost directly over the front face 10' of the head.

Located on either side of the head's central section 20 is a 'J'-shaped end portion 24. The head's front surface 10 forms the body of the 'J' and the head's rear surface 12 forms the small, outer end portion of the 'J'. In this manner, the front surface 10 extends the entire length of the head. The 'J'-shape of each end portion 24 provides the head with both structural strength and continuity while minimizing its weight.

The head's configuration enables the substantially rectilinear top surface 26 of the head's central section to visually stand apart from the rest of the head in an easily discernable manner. The body of surface 26 is preferably between 0.5 and 1.5 inches in width, between 0.5 and 1.5 inches in length and extends approximately 0.75 to 1.0 inches above the valley 27 of each of the adjacent end portions 24. In its most preferred form, the body of surface 26 has a width of one inch.

It should be noted that the body of surface 26 is oriented perpendicular to the plane formed by the head's front surface 10. This enables surface 26 to be usable as a large reference point for judging the head's position when the head is moving toward a golf ball. In this manner, aiming the putter when it is being swung is made easier.

The front surface 10 of the head portion 2 of the putter is substantially flat and vertically-oriented. As can be seen in FIGS. 3–6, the front surface is located in a raised position above a curved bottom surface 28 of the head.

Unlike the front surface, the rear surface 12 is predominantly curved in a generally upward direction. The bottom surface also is arcuately-shaped to form a concave shape between the front and rear surfaces of the head. As can be seen in FIG. 1, the bottom surface 28 is also curved in an upward direction away from the nadir 30 of the head's central section 20 to its side edges 32. The above-described compound curvatures help to prevent the head from catching on the green during a swing and facilitates a user's applying top spin to the golf ball.

Besides all of the advantages previously noted for the use of 'J'-shaped end portions 24, the two 'J'-shaped portions combined with the compound curved configuration of the putter also allows a rocking action (note FIG. 5) of the putter. As the putter contacts the ball, it can rock on its bottom surface to enhance and optionally lengthen its contact time with the ball 34. This improves the ability of the club to affect the trajectory of the ball. It should also be noted in FIG. 5 that the curved bottom surface allows one to easily alter the height and angle at which surface 10 will impact on the ball 34 to thereby facilitate a golfer's application of spin to the ball.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A golf putter comprising:

an elongated shaft having a first end portion and a second end portion; and a head member secured to said first end portion of said shaft and wherein said head member includes a central section, two side sections that have a 'J'-shaped cross-section, a front surface adapted for contacting a golf ball, a rear surface opposite said front surface and wherein said front and rear surfaces form opposite sides of each of said side sections, and a curved bottom surface that forms a 'U'-shaped arcuate path extending between the front and rear surfaces of the head member, said two side sections that have a 'J'-shaped cross-section and said curved bottom surface both allowing a rocking action for preventing said head member from catching during a swing and facilitating application of top spin during said swing.

2. The golf putter of claim 1 wherein said shaft is secured to the head member's central section.

3. The golf putter of claim 2 wherein the first end portion of said shaft is substantially straight and is oriented perpendicular to a longitudinal axis of said head member.

4. The golf putter of claim 3 wherein said shaft includes a bend located between its first and second end portions and wherein said first end portion is non-parallel to the second end portion.

5. The golf putter of claim 4 wherein the shaft's second end portion includes a grip means designed to be gripped by a user when the golf putter is being swung by said user.

6. The golf putter of claim 1 wherein the front surface of the head member is substantially planar and is oriented parallel to a longitudinal axis of the head member.

7. The golf putter of claim 6 wherein the shaft attaches to the head member at a location that is closer to the head member's front surface than to the head member's rear surface.

8. The golf putter of claim 6 wherein the shaft attaches to the head member at a location that is positioned on a longitudinal central axis of the head member.

9. The golf putter of claim 1 wherein at least a portion of the rear surface of the head member is in the form of an arcuate shape.

10. The golf putter of claim 1 wherein the head member has a first side edge and a second side edge and wherein each of said first and second side edges forms a side edge of an associated one of said 'J'-shaped side sections and wherein the bottom surface of the head member curves upwardly from a nadir point located below the head member's central section to each of said first and second side edges.

11. The golf putter of claim 1 wherein the head member has a first side edge and a second side edge and wherein each of said first and second side edges forms a side edge of an associated one of said 'J'-shaped side sections and wherein the bottom surface of the head member curves upwardly from a nadir point located below the head member's central section to each of said first and second side edges.

12. The golf putter of claim 1 wherein the head member's central section has a substantially rectangular top surface that is visually discernable from a location above the head member.

13. The golf putter of claim 12 wherein the top surface of the head member's central section has a width of at least one-half inch.

14. The golf putter of claim 12 wherein the top surface of the head member's central section is substantially rectangular and has a width substantially equal to one-inch.

15. A golf putter consisting essentially of:

an elongated shaft having a first end portion and a second end portion; and a head member secured to said first end portion of said shaft and wherein said head member includes a central section, two side sections that have a 'J'-shaped cross-section, a front surface adapted for contacting a golf ball, a rear surface opposite said front surface and wherein said front and rear surfaces form opposite sides of each of said side sections and wherein the head member has a first side edge and a second side edge and wherein each of said first and second side edges forms a side edge of an associated one of said 'J'-shaped side sections and a curved bottom surface of the head member curves upwardly form a nadir point located below the head member's central section to each of said first and second side edges and wherein said curved bottom surface also forms a 'U'-shaped arcuate path extending between the front and rear surfaces of the head member, said two side sections that have a 'J'-shaped cross-section and said curved bottom surface both allowing a rocking action for preventing said head member from catching during a swing and facilitating application of top spin during said swing.

16. The golf putter of claim 15 wherein the shaft attaches to the head member at a location between the head member's front and rear surfaces.

17. A golf putter consisting essentially of:

an elongated shaft having a first end portion and a second end portion; and a head member secured to said first end portion of said shaft and wherein said head member includes a central section, two side sections that have a 'J'-shaped cross-section, a front surface adapted for contacting a golf ball and a rear surface opposite said front surface and wherein said front and rear surfaces form opposite sides of each of said side sections and wherein the head member has a first side edge and a second side edge and wherein each of said first and second side edges forms a side edge of an associated one of said 'J'-shaped side sections, and a curved bottom surface that forms a 'U'-shaped arcuate path extending between the front and rear surfaces of the head member, said two side sections that have a 'J'-shaped cross-section and said curved bottom surface both allowing a rocking action for preventing said head member from catching during a swing and facilitating application of top spin during said swing and wherein the shaft attaches to the head member at a location that is between the head member's front and rear surfaces.

* * * * *